United States Patent [19]

Dieleman et al.

[11] B 3,982,149

[45] Sept. 21, 1976

[54] CAMERA TUBE HAVING A TARGET WITH HETEROJUNCTION

[75] Inventors: Jan Dieleman; Arthur Marie Eugene Hoeberechts, both of Eindhoven, Netherlands

[73] Assignee: U.S. Philips Corporation, New York, N.Y.

[22] Filed: Oct. 17, 1974

[21] Appl. No.: 515,455

[44] Published under the second Trial Voluntary Protest Program on January 27, 1976 as document No. B 515,455.

[30] Foreign Application Priority Data

Oct. 27, 1973 Netherlands ..... 7314804

[52] U.S. Cl. ..... 313/366; 313/94

[51] Int. Cl.[2] ..... H01J 29/45; H01J 31/38

[58] Field of Search ..... 313/366, 386, 367, 94; 252/62.3 CA, 62.3 V

[56] References Cited

UNITED STATES PATENTS

| | | | |
|---|---|---|---|
| 3,271,591 | 9/1966 | Ovshinsky | 357/2 X |
| 3,821,662 | 6/1974 | Dewinter et al. | 357/61 X |

FOREIGN PATENTS OR APPLICATIONS

| | | | |
|---|---|---|---|
| 2,097,370 | 3/1972 | France | 313/366 |

*Primary Examiner*—Robert Segal
*Attorney, Agent, or Firm*—Frank R. Trifari; Carl P. Steinhauser

[57] ABSTRACT

A camera tube target scanned by an electron beam having a radiation-receiving silicon layer which on a side to be scanned by the electron beam has a chalcogen-containing layer comprising at least one element of the third main group of the periodic table of elements, e.g., gallium which forms a heterojunction with the silicon layer.

13 Claims, 4 Drawing Figures

CAMERA TUBE HAVING A TARGET WITH HETEROJUNCTION

The invention relates to a camera tube having an electron source and a target to be scanned by an electron beam emerging from said source, said target being formed by a silicon layer which receives radiation and which on its side to be scanned by the electron beam has a chalcogen-containing layer which forms a hetero junction with the silicon layer. Radiation is to be understood to mean herein electro-magnetic radiation both in the visible and in the short wave and long wave part of the spectrum, as well as corpuscular radiation to which the silicon is sensitive. The chalcogens include sulphur, selenium and tellurium. A hetero junction is a junction between two layers of materials having different chemical compositions, not counting possibly present doping materials.

Camera tubes of the types mentioned in the preamble have already been described in literature several times. Other known camera tubes have, for example, targets which have a mosaic of diodes on the side to be scanned by the electron beam, the diodes being separated by materials which is covered with an insulating layer. Targets having mosaics of diodes often show the drawback of burningin by X-rays generated in the camera tube and of so-called "MOS-blooming" in which due to channel formation below the oxide layer, in particular with comparatively large radiation intensity, generatred charge carriers flow to adhacent diodes so that the picture disappears.

In targets having in principle one hetero junction the said problems of targets having mosaics of diodes are not expected and it is furthermore to be expected that they can be manufactured more easily than the last-mentioned targets. It is also known, however, that the quality of the hetero junctions is often poor and only few of the expected advantages have been realised as a result of a poor matching of the properties of the two layers which form the hetero junction. This may result in too high a transverse conductivity and in increased recombination of charge carriers generated by radiation so that the resolving power and the sensitivity relative to targets having a multiple of laterally insulated diodes decrease considerably.

It may be tried, for example, to reduce the transverse conductivity (see, for example, the article by Yamator c.s. in I.E.E.E. Trans. Electr. Devices, 19, pp. 385–386 (No. 3, March 1972)) by providing a silicon body with an insulating oxide layer in which on the oxide layer and in apertures therein a cadmium telluride layer is provided on the silicon. A camera tube having such a target requires more process steps in the manufacture as compared with that having a continuous hetero junction, is comparatively show and, like other known targets having hetero junctions, is little sensitive. Also, for example, a target known from Dutch Patent Application 71.13247 and comprising a silicon layer which is connected to an antimony trisulphite layer via a continuous hetero junction has a small sensitivity (see, for example, also FIG. 8 of the article by J.A.Hall in "Photo-electronic Image Devices" pp. 229–240 in Advances in Electronics and Electron Physics, Vol. 33A, 1972), so that the output signal of the tube is not obtained via the primary electron beam but by amplification of the electron beam reflected by the antimony-trisulphite layer.

Moreover, a sulphur- or selenium-containing layer forming a hetero junction with a radiation-receiving silicon plate often has a very high resistance so that a camera tube which has such a target often is slow.

One of the objects of the invention is to avoid the above-mentioned problems at least for the greater part and to provide a camera tube which has an optimum combination of properties and which can be manufactured in a simple manner.

The invention is inter alia based on the recognition that the target of such a camera tube should in particular have a hetero junction of a good quality, cq. a good matching of the silicon layer and the chalcogencontaining layer with respect to bands, Fermi levels and crystal lattices, while avoiding annoying defects and intermediate layers in the hetero junction as much as possible.

The camera tube mentioned in the preamble is therefore characterized in that the chalcogen-containing layer comprises at least one element belonging to the third main group of the periodic table of elements. The chalcogen-containing layer has substantially intrinsic conductivity.

The chalcogen-containing layer preferably contains gallium. Particularly good results have been obtained with a chalcogen-containing layer which contains gallium and selenium with more than 40 atom% gallium.

The sensitivity of a camera tube having such a target may be compared with that of a known silicon vidicon tube having a mosaic of diffused diodes. Recombination of charge carriers at the hetero junction between the silicon layer and the chalcogen-containing layer containing the element of the third group is small. The resolving power is large, details of approximately 10$\mu$m can be detected by the electron beam on a normal vidicon format (12.8×9.6 mm) and with 25 pictures per second.

The chalcogen-containing layer preferably contains approximately 48 atom% gallium and 52% selenium. The chalcogen-containing layer may also contain more than one chalcogen.

For example, while maintaining the good properties, up to maximum 40 atom% of the selenium may be replaced by tellurium or 10 atom% of the selenium may be replaced by sulphur. More than one element of the third group may also be added and 10 atom% of the gallium may be replaced by indium and maximum 20 atom% of the gallium may be replaced by aluminium.

With a vitreous or substantially vitreous structure of the chalcogen-containing layer compositions which are optimum for the properties may be chosen. Camera tubes having targets in which the chalcogen-containing layer consists of two suitable sub-layers, for example, one which adjoins the silicon layer and contains gallium and the other germanium, may also be used as will be described hereinafter. The hetero junction between the silicon layer and the chalcogen-containing layer may be a rectifying junction. In these targets, silicon is of the *n* conductivity type.

A good comparison with a planar silicon vidicon tube may be made by replacing the insulating silicon oxide layer which is normally present on the side to be scanned by the electron beam by a continuous chalcogen-containing layer according to the invention. The properties of the target thus manufactured can usually be compared with those of the planar target which was started from.

The invention is not restricted to targets having silicon layers of the n-conductivity type.

In an embodiment of the camera tube according to the invention the silicon layer comprises a rectifying junction which is separated from the hetero junction by a high-ohmic layer of the p-type. Low ohmic regions of the p-type which are separated from each other and adjoin the hetero junction may be formed in the high-ohmic layer.

The invention furthermore relates to a target which is suitable for use in a camera tube formed by a radiation-receiving silicon layer which on a side to be scanned by an electron beam has a chalcogen-containing layer which forms a hetero junction with the silicon layer and which is characterized in that the chalcogen-containing layer comprises at least one element of the third main group of the periodic table of elements.

The invention also relates to a method of manufacturing a target and is characterized in that after the formation of the hetero junction the silicon layer and the chalcogen-containing layer are subjected to a thermal treatment.

The temperature during the thermal treatment preferably is below 600°C.

The invention will now be described in greater detail with reference to a number of examples and the accompanying drawing.

In the drawing

Figure 1:
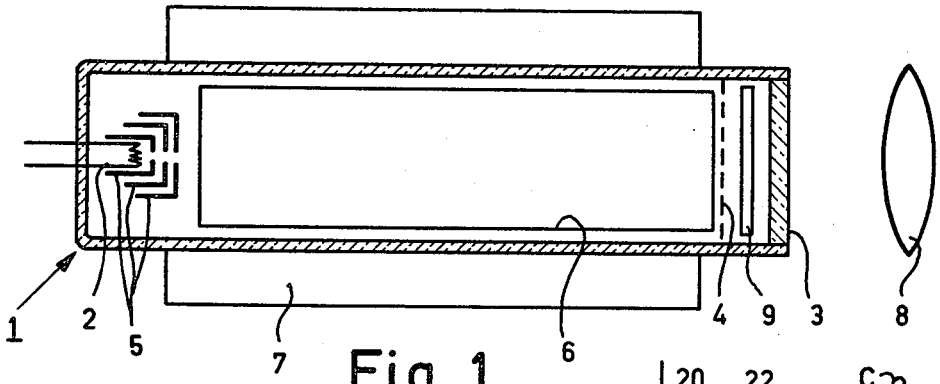
FIG. 1 shows diagrammatically a camera tube according to the invention.

The camera tube, for example a television camera tube, shown in FIG. 1 has an electron source or cathode 1 and a target 9 (see also FIG. 2) to be scanned by an electron beam 20 generated by said source. The target 9 is formed by a silicon layer 21 receiving radiation 24 which on a side to be scanned by the electron beam 20 has a chalcogen-containing layer 22 which forms a hetero junction 23 with the silicon layer 21.

According to the invention, the chalcogen-containing layer 22 comprises at least one element of the third main group of the periodic table of elements.

In the usual manner the camera tube comprises electrodes 5 to accelerate electrons and to focus the electron beam. Furthermore conventional means are present to deflect the electron beam so that the target 9 can be scanned. Said means consist, for example, of a system of deflection coils 7. The electrode 6 serves to screen the wall of the tube from the electron beam. a picture A be picked up is projected on the target 9 by means of the lens 8, the wall 3 of the tube being permeable to radiation.

Furthermore, a collector grid 4 is present in the usual manner. By means of this grid which may be, for example, also an annular electrode, reflected and secondary electrons originating from the target 9, for example may be removed.

Figure 2:
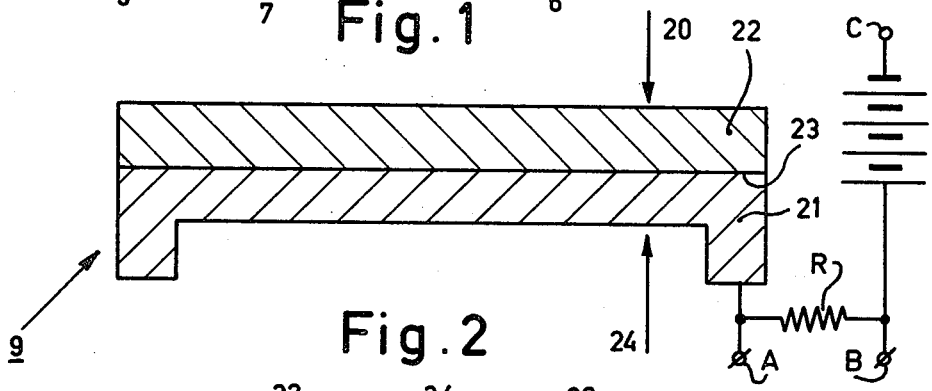
FIGS. 2, 3 and 4 show diagrammatically several embodiments of a target for a camera tube according to the invention.

During operation the silicon layer 21 is biased positively relative to the cathode 2. In FIG. 2 the cathode is to be connected to the point C. During the scanning of the chalcogen-containing layer 22 by the electron beam 20, said layer is charged to substantially the cathode potential the hetero junction 23 which in FIG. 2 is also a rectifying junction being reversely biased.

The layer 22 is then discharged fully or partly dependent upon the intensity of the radiation 24 which impinges upon the target. In a subsequent scanning period charge is again supplied until the layer 22 has again assumed the cathode potential. Said charge current is a measure of the intensity of the radiation 24. Output signals are derived from the terminals A and B via the resistor R.

EXAMPLE I

In the centre of an n-type silicon plate having a resistivity of approximately 10 Ohm.cm, a diameter of approximately 20 mm and a thickness of approximately 150 $\mu$m, a cavity having a diameter of approximately 17 mm is etched to such a depth that the thickness of the remaining silicon layer 21 is approximately 12 mm. The side of the layer 21 to be scanned by the electron beam is then cleaned as readily as possible and oxide is removed. A gallium and selenium-containing vitreous layer 22 is then vapour-deposited on the said side in a thickness between 0.01 and 10 $\mu$m, for example 0.5 $\mu$m, on the layer 21 in a high vacuum of approximately $10^{-7}$ Torr. In this case the layer 22 is vapour-deposited by bringing a quartz vessel containing a mixture of GaSe and $Ga_2Se_3$ having approximately the eutectic composition at approximately 1,080°C and catching the formed vapour on the layer 21 which itself is maintained at a temperature of approximately 300°C. Upon analysis, the gallium-selenium-glass layer thus formed proved to contain approximately 48 atom% Ga and to have a resistance of approximately $2.10^{14}$Ohm/per square. The target 9 thus formed is then mounted in a television camera tube with the gallium-selenium-glass layer facing the electron source 2 and the cavity facing the wall 3 of the camera tube. The electron beam 20 then scans the gallium-selenium-glass layer 22 and the radiation 24 impinges upon the silicon layer 21 via the wall 3 of the camera tube. With a voltage difference of approximately 20 volt across the target the sensitivity proved to be comparable to that of a known Si vidicon having a mosaic of p-type Si regions, the lag was very low and the resolving power was excellent.

At voltages lower than 20 volts, high lag, negative after-image and smaller sensitivity were sometimes established. At voltages higher than 25 volts, secondary emission sometimes occurred.

EXAMPLE II

A target obtained in a similar manner as in Example I was mounted in a similar manner in a television camera tube. During the evacuation of the tube the assembly was maintained at 450°C for 1 hour. Already at a voltage difference of a few volts across the target the sensitivity prouded to be comparable to that of a known Si vidicon having a mosaic of p-type Si regions. The lag was also very low and there was no visible negative after-image. The voltage across the target can be increased to a much higher value than in example I before annoying secondary emission was experienced.

Secondary emission can also be reduced by vapour-depositing a thin layer of antimony trisulphite or germanium sulphite on the gallium selenide layer.

EXAMPLE III

Layers consisting of a mixture of Ga, Se and Te were provided on an Si layer as stated in Example I in a thickness of approximately 0.5 microns. The mixtures in the quartz vessel were formed by replacing in a mixture of GaSe and $Ga_2Se_3$ having approximately the eutectic composition successively 10, 20 and 40 atom% of the Se by Te. The resulting targets were then mounted in a television camera tube in a manner as stated in Example I. At a sufficiently high voltage across the targets the sensitivity proved to be of the same order of magnitude as that of the conventional Si vidicon, the lag was very low and the resolving power excellent. Above 40 atom% Te the sensitivity was considerably lower.

EXAMPLE IV

A layer consisting of Ga, Se and S was provided on a suitable Si layer in a manner which is comparable to that stated in Example I in a thickness of approximately 0.5 micron. The silicon layer used in this Example has a 0.2 $\mu$m thick $n^+$ contact layer (phosphorus diffusion) on the picture side. The mixture in the quartz vessel was formed by replacing in a mixture of GaSe and $Ga_2Se_3$ having approximately the eutectic composition 10 atom% of the Se by S. The resulting target was mounted in a television camera tube in a manner as described in Example I. At a sufficiently high voltage across the target the lag proved to be very low and the resolving power excellent, while the sensitivity was of the same order of magnitude as that of the conventional Si vidicon.

EXAMPLE V

A layer consisting of Ga, In and Se was provided on a suitable Si layer in a manner corresponding to that stated in Example I in a thickness of approximately 0.5 micron. The mixture in the quartz vessel was formed by replacing in a mixture of GaSe and $Ga_2Se_3$ having approximately the eutectic composition 10 atom% of the Ga by In. The resulting target was mounted in a television camera tube in a manner as stated in Example I. The lag proved to be very low and the resolving power excellent, while the sensitivity was of the same order of magnitude as the sensitivity of the conventional Si vidicon.

EXAMPLE VI

In a manner as stated in Example I, layers consisting of Ga, Al and Se were provided on a suitable Si layer in a thickness of approximately 0.5 micron. The mixtures in the quartz vessel were formed by replacing in a mixture of GaSe and $Ga_2Se_3$ having approximately the eutectic composition successively 5, 10 and 20 atom% of the Ga by Al. The television camera tubes manufactured with said targets in a manner analogous to Example I proved to have a very low lay and a good resolving power at a sufficiently high voltage across the target. The sensitivity proved to by 2 to 3× lower than that of the conventional Si vidicon.

EXAMPLE VII

Tubes having targets as described in Example VI were maintained at a temperature of 400°C for 1 hour during the evacuation. At sufficiently high voltages across the target the sensitivity is comparable to that of the conventional Si vidicon, while a smaller annoying effect is experienced due to the occurrence of secondary emission.

EXAMPLE VIII

Starting material is a finished good target manufactured according to the known planar method and consisting of an n-type silicon substrate having an $n^+$ contact layer and a mosaic of $p^+$ regions being diffused into the substrate by means of an $SiO_2$ layer as a diffusion mask. The $SiO_2$ layer is removed from said target by an etching treatment. The target is then thoroughly cleaned and provided with an approximately 0.5 micron thick layer of GaSe substantially throughout the surface of the Si layer which is to be scanned afterwards by the electron beam. The target is then mounted in a camera tube with an electron source and is then evacuated and activated in a usual manner. The resulting camera tube shows properties which are comparable to the properties of a tube having the planar target which was started from and this in spite of the fact that the glass layer on the p-type islands now forms a series resistance. On the n-type Si between the islands the operation of the target is the same as in the preceding Examples.

It has been demonstrated in the targets according to this Example that the p-type islands may approach each other up to approximately 1 micron. It will be obvious to those skilled in the art that instead of $p^+$ regions also islands of Schottky varriers are possible.

The invention is not restricted to n-type silicon layers. This may become apparent from the following Examples. As is assumed, in n-type material a depletion layer is formed in the silicon at the hetero junction with the chalcogen-containing layer which at higher voltage expands mainly in the silicon. It is also possible to start from a junction in the silicon layer and to expand the depletion layer by suitable choice of voltages to the GaSe layer as will be described in greater detail in Examples IX and X.

EXAMPLE IX

Figure 3:
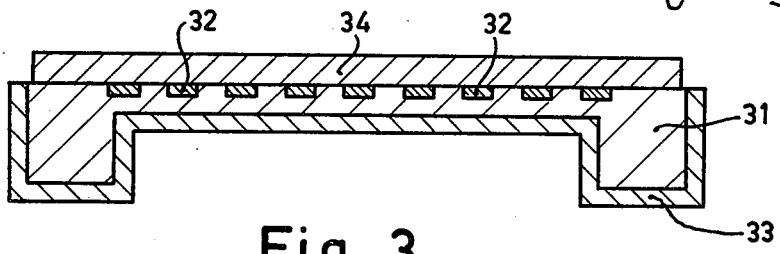

A p-type (1000 ohm cm) Si slice 31 (see FIG. 3) was provided in the usual manner with an oxide layer in which a mosaic of windows was obtained by means of a photo-etching process. The slice was then subjected to a diffusion treatment in which boron was diffused as an impurity and boron regions 32 were formed down to a depth of approximately 2 $\mu$m in an oxidizing atmosphere. The slice was then partly thin-etched on the other side until a layer having a thickness of approximately 12 $\mu$m and subjected to a phosphorus diffusion treatment in which an $n^+$ layer 33 was formed. All the $SiO_2$ still present was then removed by a HF-containing etchant and an approximately 0.5 $\mu$m thick GaSe layer 34 was provided on the p-type surface which is now provided with comparatively low-ohmic insulated p-type regions 32. A camera tube was then manufactured using the slice thus treated as a target. Said method provides useful tubes provided the target voltage be 4 volts higher than that of the cathode, while the light quantity must not be so large that the capacity resulting from diodes in the reverse voltage is fully or locally discharged in a picture time of 40msec. to a voltage of less than 4 volts and sharpness and sensitivity impair. The picture on the layer 33 can be formed by fast electrons (> 1 kV).

EXAMPLE X

Figure 4:
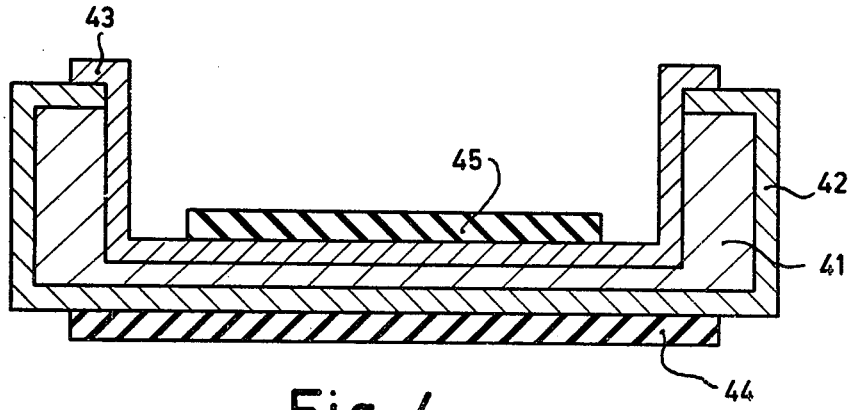

A high-ohmic p-type Si slice 41 (see FIG. 4) (for example 1,000 ohm.cm) is subjected to a phosphorus doping at approximately 1,000°C in known manner using $POCl_3$ as a source, the $n^+$ layer 42 being formed. The slice is then etched partly on one side to a thickness of approximately 10 microns. On the p-type surface now released again and partly over the remaining edge a GaSe layer 43 is provided. After mounting in a camera tube it is found that at a voltage larger than approximately 5 volts pictures can be obtained with a sharpness, sensitivity and lag which are comparable to those of a known Si vidicon having a mosaic of p-type regions in an n-type substrate. 44 in FIG. 4 denotes an anti-reflection layer and 45 denotes a layer of the GaSe layer 43 of, for example, $Sb_2S_3$ which enables the use of the target at voltages higher than approximately 30 volts by reducing the secondary emission.

It will be obvious that the invention is not restricted to the examples described but that many variations are possible to those skilled in the art without departing from the scope of this invention. For example, it is not necessary for the silicon layer to be monocrystalline, it may also be polycrystalline. The thickness and the resistance of said layer and the composition of the chalcogen-containing layer may also be different from what is stated in the examples.

The resistance of the chalcogen-containing layer usually is between $10^{12}$ and $10^{15}$ ohm/per square.

One is not restricted to the provision of the chalcogen-containing layer by vapour-deposition and the conditions of the thermal treatment of the target may be varied as regards time and temperature.

In the circumstances described in the examples the composition of the vapour-deposited chalcogen-containing layer does not substantially differ from the composition of the deposition source used.

A thin oxide layer of less than 30 Angstrom may be present between the silicon layer and the chalcogen-containing layer.

It is not necessary for a good operation of the camera tube according to the invention that the chalcogen-containing layer has a homogeneous composition; a similar layer having a variation in composition may also give satisfactory results.

What is claimed is:

1. A camera tube comprising an evacuated envelope and within the envelope an electron source, a target to be scanned by an electron beam emerging from said source, said target comprising a radiation-receiving silicon layer which on the side to be scanned by the electron beam has a chalcogen-containing layer which forms a hetero junction with the silicon layer, said chalcogen-containing layer comprising gallium.

2. A camera tube as claimed in claim 1, wherein the chalcogen-containing layer comprises gallium and selenium with more then 40 atom% of gallium.

3. A camera tube as claimed in claim 2, wherein the chalcogen-containing layer comprises approximately 48 atom% gallium and 52 atom% selenium.

4. A camera tube as claimed in claim 2, wherein at most 40 atom% of the selenium is replaced by tellurium.

5. A camera tube as claimed in claim 2, wherein at most 10 atom% of the selenium is replaced by sulphur.

6. A camera tube as claimed in claim 2 wherein at most 10 atom% of the gallium is replaced by kndium.

7. A camera tube as claimed in claim 2, wherein at most 20 atom% of the gallium is replaced by aluminium.

8. A camera tube as claimed in claim 1 wherein the chalcogen-containing layer has a vitreous structure.

9. A camera tube as claimed in claim 1 wherein the chalcogen-containing layer consists of two sub-layers of which one which adjoins the silicon layer comprises gallium and the other comprises germanium.

10. A camera tube as claimed in claim 1, wherein the hetero junction is a rectifying junction.

11. A camera tube as claimed in claim 1, wherein the silicon layer comprises a rectifying junction which is separated from the hetero junction by a high-ohmic layer of p-type conductivity.

12. A camera tube as claimed in claim 11, wherein mutually separated low-ohmic regions of the p-type are formed in the high-ohmic layer and adjoin the hetero junction.

13. A target suitable for use in a camera tube comprising a radiation-receiving silicon layer which on a side to be scanned by an electron beam has a chalcogen-containing layer which forms a hetero junction with the silicon layer, said chalcogen-containing layer comprising gallium.

* * * * *

UNITED STATES PATENT AND TRADEMARK OFFICE

CERTIFICATE OF CORRECTION

PATENT NO. : 3,982,149
DATED : September 21, 1976
INVENTOR(S) : JAN DIELEMAN ET AL It is certified that error appears in the above-identified patent and that said Letters Patent are hereby corrected as shown below:

Column 2, line 13, change "chalcogencontaining" to read --chalcogen-containing--;

Column 3, line 49, after "beam." delete "a" and insert --A--;

Column 3, line 50, after "picture" delete "A" and insert --to--;

Column 4, line 50, change "prouded" to read --proved--;

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*